US007826765B2

(12) United States Patent
Kuba

(10) Patent No.: US 7,826,765 B2
(45) Date of Patent: Nov. 2, 2010

(54) DEVELOPER CONTAINER AND IMAGE FORMING APPARATUS INCLUDING THE DEVELOPER CONTAINER WITH SEALING MECHANISM PROVIDING ENHANCED USABILITY

(75) Inventor: Yasuhiro Kuba, Sagamihara (JP)

(73) Assignee: Ricoh Company, Limited, Tokyo (JP)

( * ) Notice: Subject to any disclaimer, the term of this patent is extended or adjusted under 35 U.S.C. 154(b) by 79 days.

(21) Appl. No.: 12/264,592

(22) Filed: Nov. 4, 2008

(65) Prior Publication Data

US 2009/0116867 A1 May 7, 2009

(30) Foreign Application Priority Data

Nov. 7, 2007 (JP) ..... 2007-290104
May 7, 2008 (JP) ..... 2008-121606

(51) Int. Cl.
*G03G 15/08* (2006.01)

(52) U.S. Cl. ..... 399/106; 399/120

(58) Field of Classification Search ..... 399/106, 399/103, 105, 111, 119, 120; 222/DIG. 1
See application file for complete search history.

(56) References Cited

U.S. PATENT DOCUMENTS 4,895,104 A 1/1990 Yoshino et al. ..... 399/106
5,206,619 A 4/1993 Kita ..... 399/111
5,404,212 A 4/1995 Ditomaso ..... 399/106
5,434,656 A * 7/1995 Nagaoka et al. ..... 399/106
5,778,282 A 7/1998 Nagashima ..... 399/106
6,484,000 B1 * 11/2002 Ogawa et al. ..... 399/106
2008/0008497 A1 1/2008 Kato et al.
2008/0219699 A1 * 9/2008 Kimura et al. ..... 399/120

FOREIGN PATENT DOCUMENTS

JP 3288892 (B2) 3/2002
JP 4092166 (B2) 3/2008

* cited by examiner

*Primary Examiner*—Sophia S Chen
(74) *Attorney, Agent, or Firm*—Oblon, Spivak, McClelland, Maier & Neustadt, L.L.P.

(57) ABSTRACT

A developer container supplies developer to a development device and includes a storage, an opening, a first seal member, a through-hole, and a second seal member. The developer is supplied from the storage to the development device through the opening. The first seal member seals the opening and is pulled in a predetermined direction to unseal the opening. The through-hole guides the first seal member toward an opposite side of the opening. The second seal member is provided on at least one of a lead-in opening and a lead-out opening of the through-hole and elastically blocks the at least one of the lead-in opening and the lead-out opening. A non-bonded portion of the second seal member elastically blocks the at least one of the lead-in opening and the lead-out opening when the first seal member is pulled out from the through-hole through the non-bonded portion.

10 Claims, 14 Drawing Sheets

DEVELOPER CONTAINER AND IMAGE FORMING APPARATUS INCLUDING THE DEVELOPER CONTAINER WITH SEALING MECHANISM PROVIDING ENHANCED USABILITY

CROSS-REFERENCE TO RELATED APPLICATIONS

The present application is based on and claims priority to Japanese Patent Application Nos. 2007-290104, filed on Nov. 7, 2007, and 2008-121606, filed on May 7, 2008 in the Japan Patent Office, the entire contents of each of which are hereby incorporated herein by reference.

BACKGROUND OF THE INVENTION

1. Field of the Invention

Exemplary aspects of the present invention relate to a developer container and an image forming apparatus, and more particularly, to a developer container for containing developer to be supplied to a development device, and an image forming apparatus including the developer container.

2. Description of the Related Art

Related-art image forming apparatuses, such as copiers, facsimile machines, printers, or multifunction printers having at least one of copying, printing, scanning, and facsimile functions, typically form an image on a recording medium (e.g., a transfer sheet) based on image data using electrophotography. Thus, for example, a charger uniformly charges a surface of a photoconductor; an optical writer emits a light beam onto the charged surface of the photoconductor to form an electrostatic latent image on the photoconductor according to the image data; a development device supplies toner particles to the electrostatic latent image formed on the photoconductor to make the electrostatic latent image visible as a toner image; the toner image is transferred from the photoconductor onto a transfer sheet; a cleaner then cleans the surface of the photoconductor after the toner image is transferred from the photoconductor onto the transfer sheet; finally, a fixing device applies heat and pressure to the transfer sheet bearing the toner image to fix the toner image on the transfer sheet, thus forming the image on the transfer sheet.

In such image forming apparatuses, typically the photoconductor and the development device are integrated into a single unit, and fresh developer containing toner particles is supplied to the development device whenever the unit is replaced. Alternatively, a developer container for containing fresh developer is detachably attached to the development device to supply the fresh developer to the development device.

In one example of a related-art developer container, a seal member seals an opening through which developer contained in the developer container is supplied to the development device. When a user pulls a pull tab provided at one end of the seal member, the seal member is removed from the opening to expose the opening. The developer is supplied from the developer container to the development device through the opening.

In order to seal the opening properly to prevent the developer from leaking from the opening, the developer container engages the development device in such a manner that a minimum of space is provided between the developer container and the development device. Accordingly, the user needs to apply a strong force to pull out the seal member from the opening, resulting in decreased usability. To address this, a larger space may be provided between the developer container and the development device. However, some developer may leak from the larger space provided between the developer container and the development device, staining an inside of the image forming apparatus.

Obviously, such decreased usability and leakage of the developer are undesirable, and accordingly, there is a need for a technology to prevent leakage of the developer and provide usability with a flexibly designed structure.

BRIEF SUMMARY OF THE INVENTION

This specification describes below a developer container according to an exemplary embodiment of the present invention. In one exemplary embodiment of the present invention, the developer container supplies developer to a development device and includes a storage, an opening, a first seal member, a through-hole, and a second seal member. The storage is configured to store the developer. The developer is supplied from the storage to the development device through the opening. The first seal member is configured to seal the opening and includes a seal portion configured to seal the opening and a pull end provided on one end of the first seal member and combined with the seal portion. The pull end is pulled in a predetermined direction to unseal the opening. The through-hole is provided in a wall of the storage and configured to guide the pull end of the first seal member toward an opposite side of the opening. The through-hole includes a lead-in opening configured to lead the pull end of the first seal member into the through-hole and a lead-out opening configured to lead the pull end of the first seal member out from the through-hole. The second seal member is provided on at least one of the lead-in opening and the lead-out opening of the through-hole and configured to elastically block the at least one of the lead-in opening and the lead-out opening. The second seal member includes a bonded portion bonded to a part of a periphery of the at least one of the lead-in opening and the lead-out opening and a non-bonded portion not bonded to the periphery of the at least one of the lead-in opening and the lead-out opening and configured to allow the first seal member to move on the non-bonded portion. The non-bonded portion elastically blocks the at least one of the lead-in opening and the lead-out opening when the first seal member is pulled out from the through-hole through the non-bonded portion.

This specification further describes below an image forming apparatus according to an exemplary embodiment of the present invention. In one exemplary embodiment of the present invention, the image forming apparatus includes a photoconductor, a development device, and a developer container. The photoconductor is configured to carry an electrostatic latent image. The development device is configured to supply developer to the electrostatic latent image formed on the photoconductor to develop the electrostatic latent image. The developer container is detachably attachable to the development device and configured to supply the developer to the development device. The developer container includes a storage, an opening, a first seal member, a through-hole, and a second seal member. The storage is configured to store the developer. The developer is supplied from the storage to the development device through the opening. The first seal member is configured to seal the opening and includes a seal portion configured to seal the opening and a pull end provided on one end of the first seal member and combined with the seal portion. The pull end is pulled in a predetermined direction to unseal the opening. The through-hole is provided in a wall of the storage and configured to guide the pull end of the first seal member toward an opposite side of the opening. The through-hole includes a lead-in opening configured to lead the pull end of the first seal member into the through-hole and a lead-out opening configured to lead the pull end of the first seal member out from the through-hole. The second seal member is provided on at least one of the lead-in opening and the lead-out opening of the through-hole and configured to elastically block the at least one of the lead-in opening and the lead-out opening. The second seal member includes a bonded portion bonded to a part of a periphery of the at least one of the lead-in opening and the lead-out opening and a non-bonded portion not bonded to the periphery of the at least one of the lead-in opening and the lead-out opening and configured to allow the first seal member to move on the non-bonded portion. The non-bonded portion elastically blocks the at least one of the lead-in opening and the lead-out opening when the first seal member is pulled out from the through-hole through the non-bonded portion.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
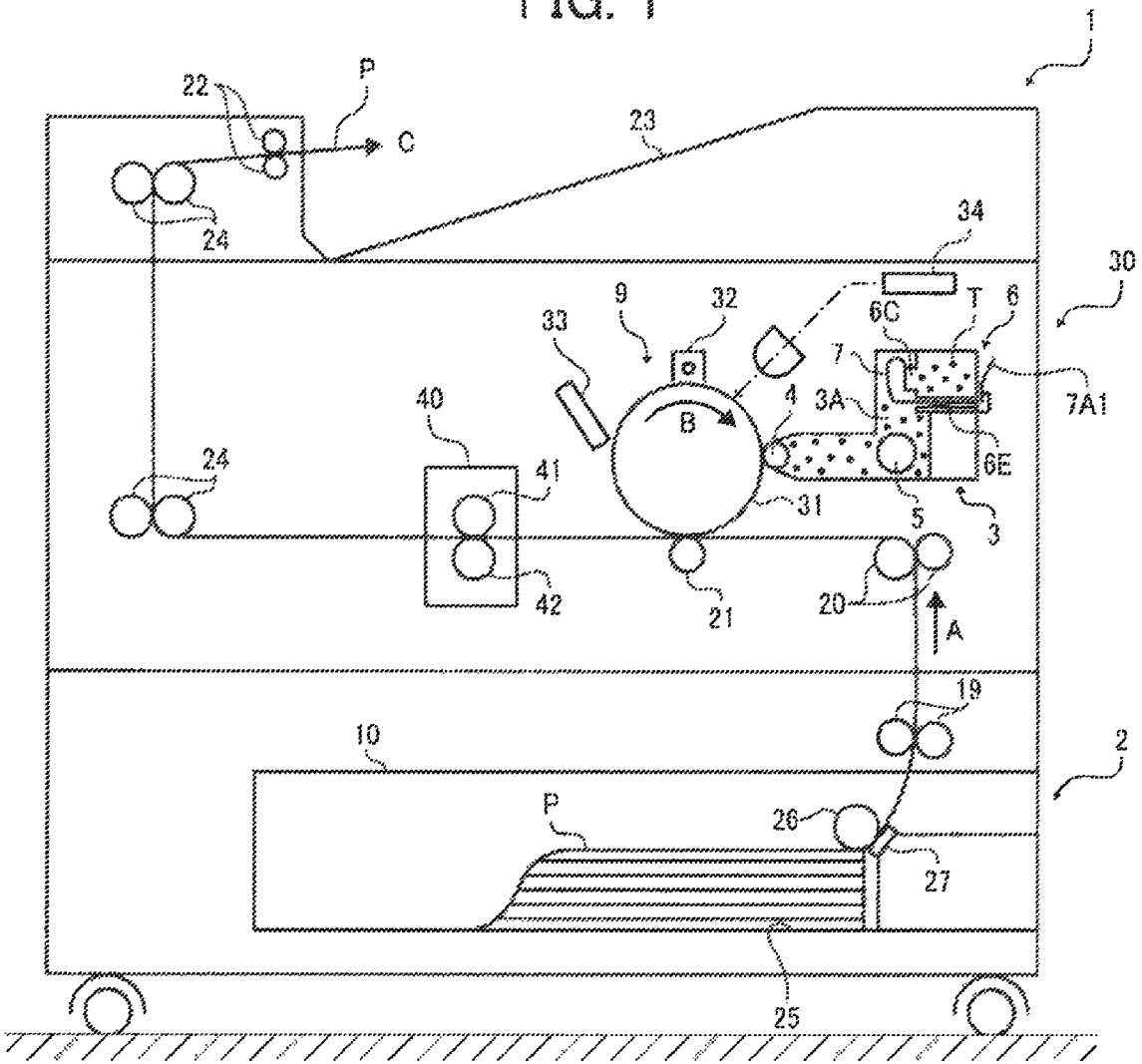
FIG. 1 is a schematic sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment of the present invention is explained.

As illustrated in FIG. 1, the image forming apparatus 1 includes an image forming device 30, a sheet supply device 2, a conveyance roller pair 19, a registration roller pair 20, a transfer roller 21, a fixing device 40, conveyance roller pairs 24, an output roller pair 22, and an output tray 23. The image forming device 30 includes a process cartridge 9 and an exposure device 34. The process cartridge 9 includes a photoconductor 31, a charger 32, a development device 3, a cleaner 33, and a developer container 6. The sheet supply device 2 includes a paper tray 10, a bottom plate 25, a pick-up roller 26, and a separation pad 27. The fixing device 40 includes a fixing roller 41 and a pressing roller 42. The development device 3 includes a development roller 4, a developer receiver 3A, and a screw 5. The developer container 6 includes an opening 6C, a first seal member 7, and a through-hole 6E. The first seal member 7 includes a tail end 7A1.

The image forming apparatus 1 can be a copier, a facsimile machine, a printer, a plotter, a multifunction printer having at least one of copying, printing, scanning, plotter, and facsimile functions, or the like. According to this non-limiting exemplary embodiment of the present invention, the image forming apparatus 1 functions as a printer for forming an image on a recording medium by electrophotography.

The image forming device 30 is provided in a center portion of the image forming apparatus 1 in a vertical direction, and forms an image on a transfer sheet P serving as a recording medium. The sheet supply device 2 is provided below the image forming device 30, and stores transfer sheets P.

In the image forming device 30, the photoconductor 31, having a drum shape, rotates in a rotating direction B. The charger 32, the development device 3, and the cleaner 33 surround the photoconductor 31. The charger 32 uniformly charges a surface of the photoconductor 31. The exposure device 34 emits a light beam onto the charged surface of the photoconductor 31 according to image data to form an electrostatic latent image on the surface of the photoconductor 31. The development device 3 supplies toner particles to the surface of the photoconductor 31 to make the electrostatic latent image formed on the surface of the photoconductor 31 visible as a toner image.

In the sheet supply device 2, the paper tray 10 loads transfer sheets P. A pusher attached to the bottom plate 25 of the paper tray 10 elastically pushes up the transfer sheets P. The rotating pick-up roller 26 and the separation pad 27 feed the transfer sheets P one by one toward the conveyance roller pair 19. The conveyance roller pair 19 feeds the transfer sheet P in a direction A toward the registration roller pair 20. The registration roller pair 20 feeds the transfer sheet P to a transfer nip formed between the photoconductor 31 and the transfer roller 21 at a proper time. At the transfer nip, the transfer roller 21 transfers the toner image formed on the surface of the photoconductor 31 onto the transfer sheet P fed by the registration roller pair 20, and feeds the transfer sheet P bearing the toner image toward the fixing device 40. After the transfer roller 21 transfers the toner image from the photoconductor 31 onto the transfer sheet P, the cleaner 33 removes residual toner particles not transferred and thereby remaining on the surface of the photoconductor 31 from the surface of the photoconductor 31.

In the fixing device 40, the fixing roller 41 and the pressing roller 42 apply heat and pressure to the transfer sheet P bearing the toner image to fix the toner image on the transfer sheet P, and feeds the transfer sheet P bearing the fixed toner image toward the conveyance roller pairs 24. The conveyance roller pairs 24 feed the transfer sheet P toward the output roller pair 22. The output roller pair 22 feeds the transfer sheet P in a direction C onto the output tray 23.

Figure 2:
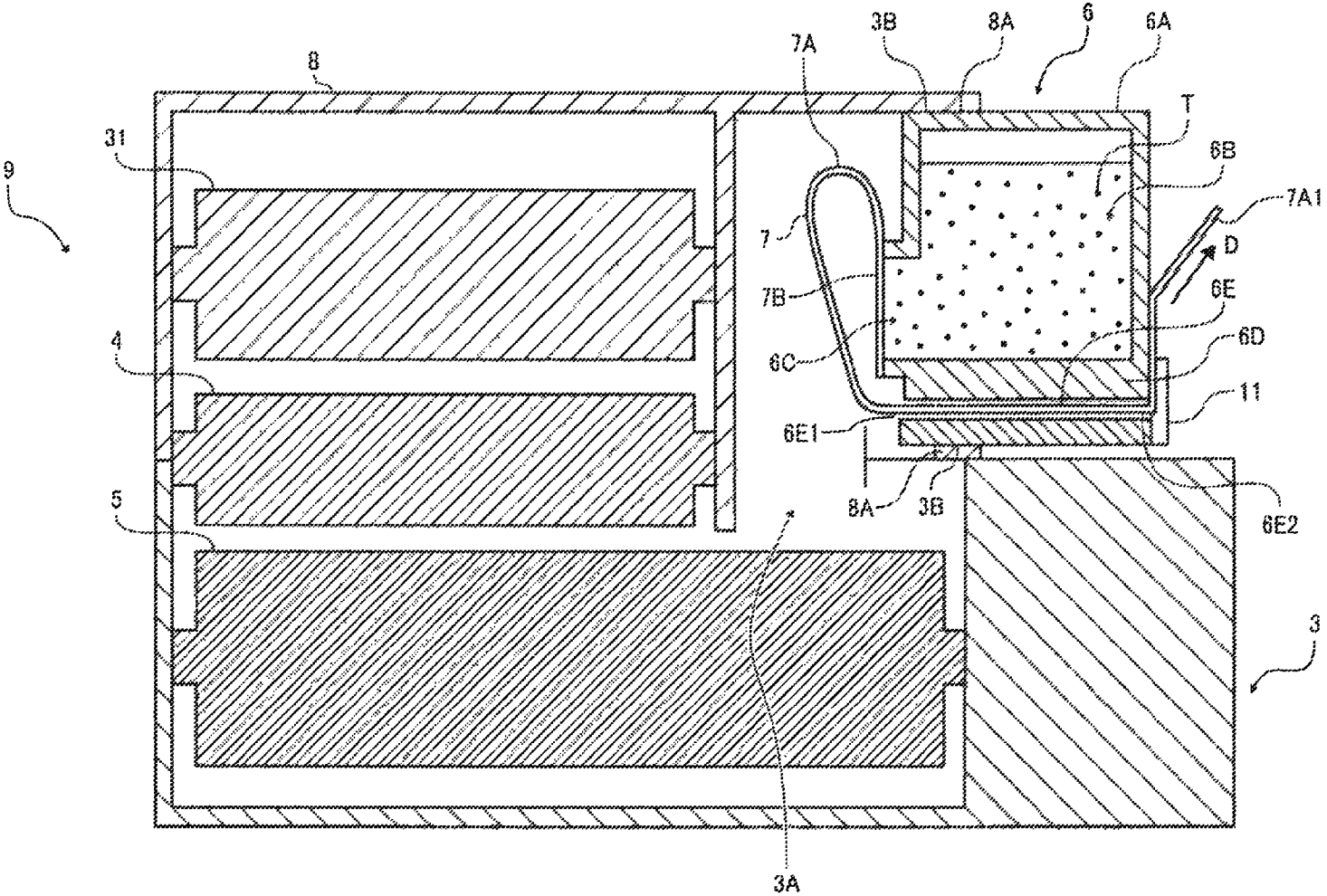
FIG. 2 is a sectional side view of a developer container included in the image forming apparatus shown in FIG. 1.

Referring to FIGS. 1 and 2, the following describes the process cartridge 9. FIG. 2 is a sectional side view of the process cartridge 9. As illustrated in FIG. 2, the process cartridge 9 further includes a frame 8. The development device 3 further includes an engaging portion 3B and an opening 8A. The developer container 6 further includes an outer wall 6A, a storage 6B, a bottom wall 6D, and a second seal member 11. The first seal member 7 further includes a pull end 7A and a seal portion 7B. The through-hole 6E includes a lead-in opening 6E1 and a lead-out opening 6E2.

The development device 3 performs a two-component development method using a developer T, that is, a two-component developer containing toner particles and magnetic carrier particles mixed with each other. In the development device 3, the development roller 4 opposes the photoconductor 31. The screw 5 conveys and supplies the developer T stored in the developer receiver 3A to the development roller 4. The development roller 4 includes a rotatable sleeve and a magnet fixed inside the sleeve. A magnetic force generated by the magnet attracts toner particles and magnetic carrier particles to a surface of the rotating sleeve, and an electric field supplies the toner particles to an electrostatic latent image formed on the surface of the photoconductor 31. Alternatively, the development device 3 may perform a one-component development method using a one-component developer containing toner particles and not containing magnetic carrier particles. Therefore, according to this exemplary embodiment, the developer T may be either a one-component developer or a two-component developer.

As illustrated in FIG. 2, the developer container 6 is inserted in the opening 8A of the development device 3 provided at an upper portion of the development device 3. The developer container 6 supplies the developer T to the developer receiver 3A of the development device 3. The engaging portion 3B of the development device 3 engages the outer wall 6A of the developer container 6. The developer container 6 is attached to the development device 3 in such a manner that the sealed developer container 6 can be detached from the development device 3. When the developer container 6 is sealed, gas does not leak from the developer container 6. Otherwise, gas leaks from the developer container 6 but at least the developer T does not leak.

In the developer container 6, the storage 6B stores the developer T. The opening 6C supplies the developer T stored in the storage 6B to the developer receiver 3A of the development device 3. The first seal member 7 includes a polyester film and seals the opening 6C by a sealing method, such as heat sealing, to prevent the developer T from leaking from the developer container 6. When the pull end 7A of the first seal member 7 is pulled into an outside of the developer container 6 and the first seal member 7 is removed from the developer container 6, the sealed opening 6C is unsealed and thereby the developer T is supplied from the storage 6B of the developer container 6 to the developer receiver 3A of the development device 3. According to this exemplary embodiment, the developer T contained in the developer container 6 may include both toner particles and carrier particles or may include toner particles only and may not include carrier particles.

The following describes examples of sealing. In the process cartridge 9, the photoconductor 31, the development roller 4, and the screw 5 are integrally attached to the frame 8. The developer container 6 is attached to the engaging portion 3B of the development device 3 in such a manner that the sealed developer container 6 can be detached from the development device 3. The engaging portion 3B is formed of an inner wall of the opening 8A for holding the developer container 6. The opening 8A is provided in the frame 8 and has a shape substantially equivalent to an outer shape of the developer container 6. When the developer container 6 is inserted in the opening 8A, the inner wall of the opening 8A engages the outer wall 6A of the developer container 6 to seal the opening 8A. The seal portion 7B of the first seal member 7 including a polyester film heat-seals an outer circumference of the opening 6C of the developer container 6.

The pull end 7A extends from an upper end of the seal portion 7B of the first seal member 7. The bottom wall 6D forms a part of the outer wall 6A of the storage 6B of the developer container 6. The through-hole 6E penetrates the bottom wall 6D from an opening side of the developer container 6 in which the opening 6C is provided to another side, that is, an outer side, opposite the opening side. The lead-in opening 6E1 is provided in the through-hole 6E at the opening side of the developer container 6. The lead-out opening 6E2 is provided in the through-hole 6E at another side (e.g., the outer side) opposite the opening side of the developer container 6. The pull end 7A is inserted into the through-hole 6E from the lead-in opening 6E1 toward the lead-out opening 6E2. Specifically, the through-hole 6E guides the pull end 7A, which is bent in an arc-shape, from the opening side of the developer container 6 to the outer side of the developer container 6. The tail end 7A1 of the pull end 7A is exposed to an outside of the through-hole 6E at the outer side of the developer container 6. Therefore, when a user catches and pulls the tail end 7A1 of the pull end 7A of the first seal member 7 in a direction D, the seal portion 7B of the first seal member 7 is pulled and separated from the opening 6C. Accordingly, the opening 6C is unsealed, and the seal portion 7B of the first seal member 7 moves through the through-hole 6E and is pulled out from the developer container 6.

In order to prevent the developer T from leaking from the lead-out opening 6E2 of the through-hole 6E, the second seal member 11, which includes elastic foam such as urethane foam (e.g., sponge), is attached to the lead-out opening 6E2 to seal the lead-out opening 6E2.

Figure 3:
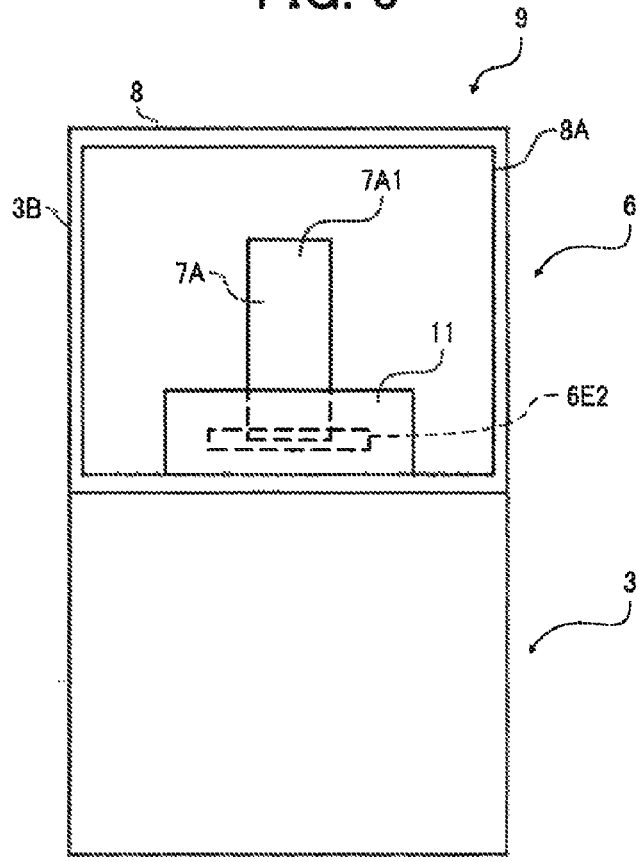
FIG. 3 is a sectional front view of the developer container shown in FIG. 2.
Figure 4:
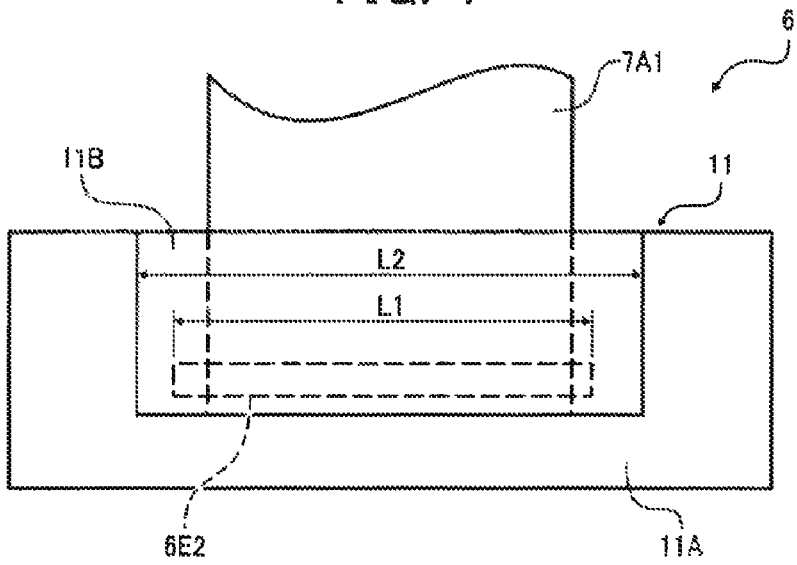
FIG. 4 is an enlarged front view of a second seal member included in the developer container shown in FIG. 3.
Figure 5:
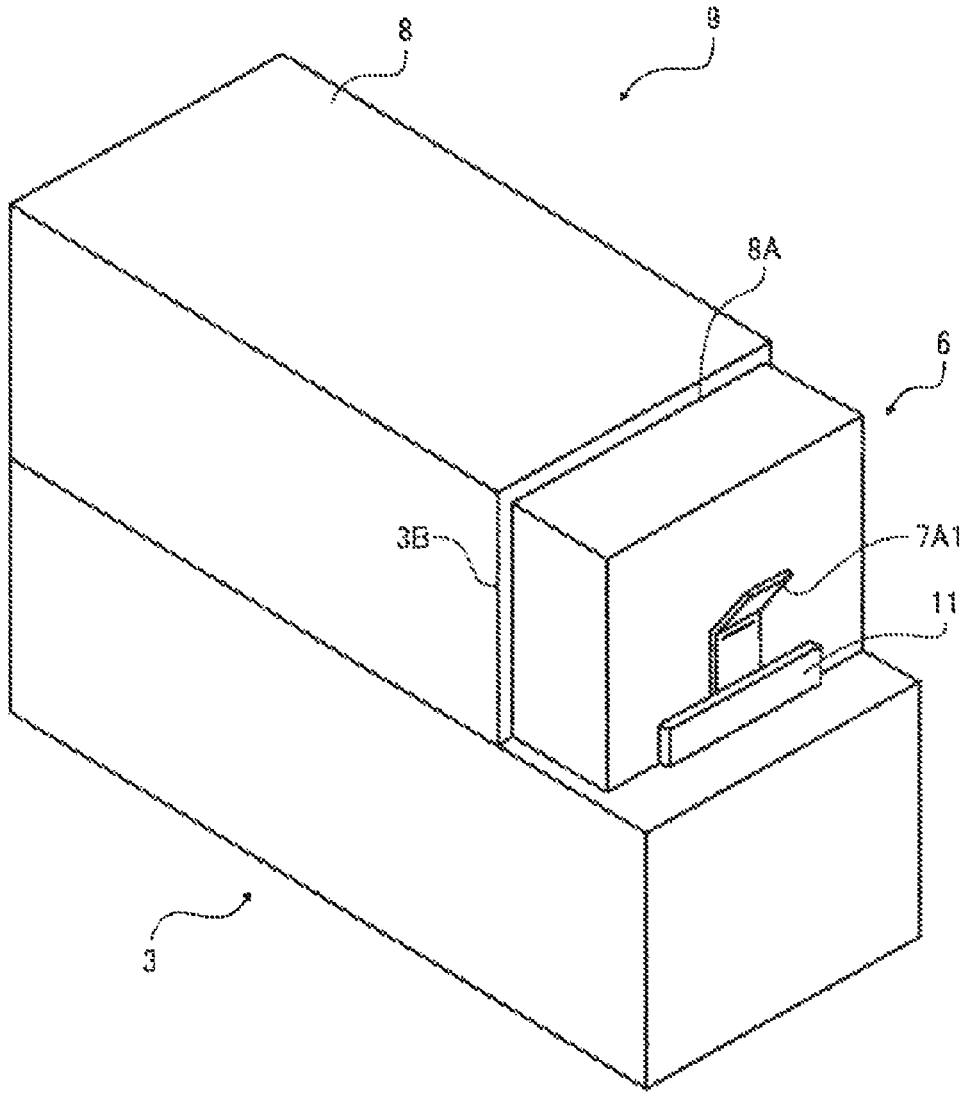
FIG. 5 is a perspective view of the developer container shown in FIG. 2.

FIG. 3 is a sectional front view of the developer container 6. FIG. 4 is an enlarged front view of the second seal member 11. The second seal member 11 includes a bonded portion 11A and a non-bonded portion 11B. FIG. 5 is a perspective view of the development device 3 and the developer container 6.

As illustrated in FIGS. 3 and 4, the second seal member 11 has an area larger than an area of the lead-out opening 6E2 of the through-hole 6E. The bonded portion 11A of the second seal member 11 is provided below and on the right and left of the lead-out opening 6E2 to have a U-like shape shaded in FIG. 4. In other words, the bonded portion 11A is bonded to a part of a periphery of the lead-out opening 6E2. Specifically, the bonded portion 11A is attached to a lower portion of the outer wall 6A (depicted in FIG. 2) of the developer container 6, which is provided below the lead-out opening 6E2 of the through-hole 6E and both side portions of the outer wall 6A, which are provided on the right and left of the lead-out opening 6E2 of the through-hole 6E with an adhesive, for example. Namely, the bonded portion 11A partially surrounds the lead-out opening 6E2 of the through-hole 6E, and is fixed and bonded to the outer wall 6A of the developer container 6. The non-bonded portion 11B of the second seal member 11 corresponds to an upper portion of the outer wall 6A of the developer container 6, which is provided substantially on and above the lead-out opening 6E2 of the through-hole 6E, and is not attached to the upper portion of the outer wall 6A. The non-bonded portion 11B has a width L2 larger than a width L1 of the lead-out opening 6E2 of the through-hole 6E. The non-bonded portion 11B elastically contacts the tail end 7A1 of the pull end 7A of the first seal member 7 guided by the lead-out opening 6E2 of the through-hole 6E so as to move the pull end 7A and the seal portion 7B of the first seal member 7 depicted in FIG. 2 upward from the lead-out opening 6E2. Accordingly, when the pull end 7A and the seal portion 7B of the first seal member 7 are pulled out from the lead-out opening 6E2 to expose the opening 6C (depicted in FIG. 2), the non-bonded portion 11B elastically contacts the outer wall 6A of the developer container 6 at the upper portion above the lead-out opening 6E2 to seal the lead-out opening 6E2. In FIG. 4, a lower edge of the lead-out opening 6E2 is separated from the bonded portion 11A. Alternatively, the lower edge of the lead-out opening 6E2 may contact the bonded portion 11A.

As illustrated in FIG. 2, the pull end 7A of the first seal member 7 is guided toward the outside of the developer container 6 opposite to the opening 6C provided inside the developer container 6 through the through-hole 6E provided below the storage 6B. Thus, leakage of the developer T from the opening 6C can be reduced or prevented. Moreover, the user can pull out the first seal member 7 easily and properly. Further, the second seal member 11 including an elastic body elastically seals the lead-out opening 6E2 of the through-hole 6E so that the elastic body of the second seal member 11 opens and closes the lead-out opening 6E2. Thus, the through-hole 6E can have a large area, decreasing a frictional resistance between the through-hole 6E and the first seal member 7. Accordingly, the user can pull out the first seal member 7 with a decreased force to unseal the opening 6C.

According to this exemplary embodiment, the through-hole 6E is provided in the thick bottom wall 6D. Alternatively, the through-hole 6E may be provided in a side wall forming a part of the outer wall 6A of the storage 6B of the developer container 6. In this case, the user can pull out the first seal member 7 in a horizontal direction.

Figure 6:
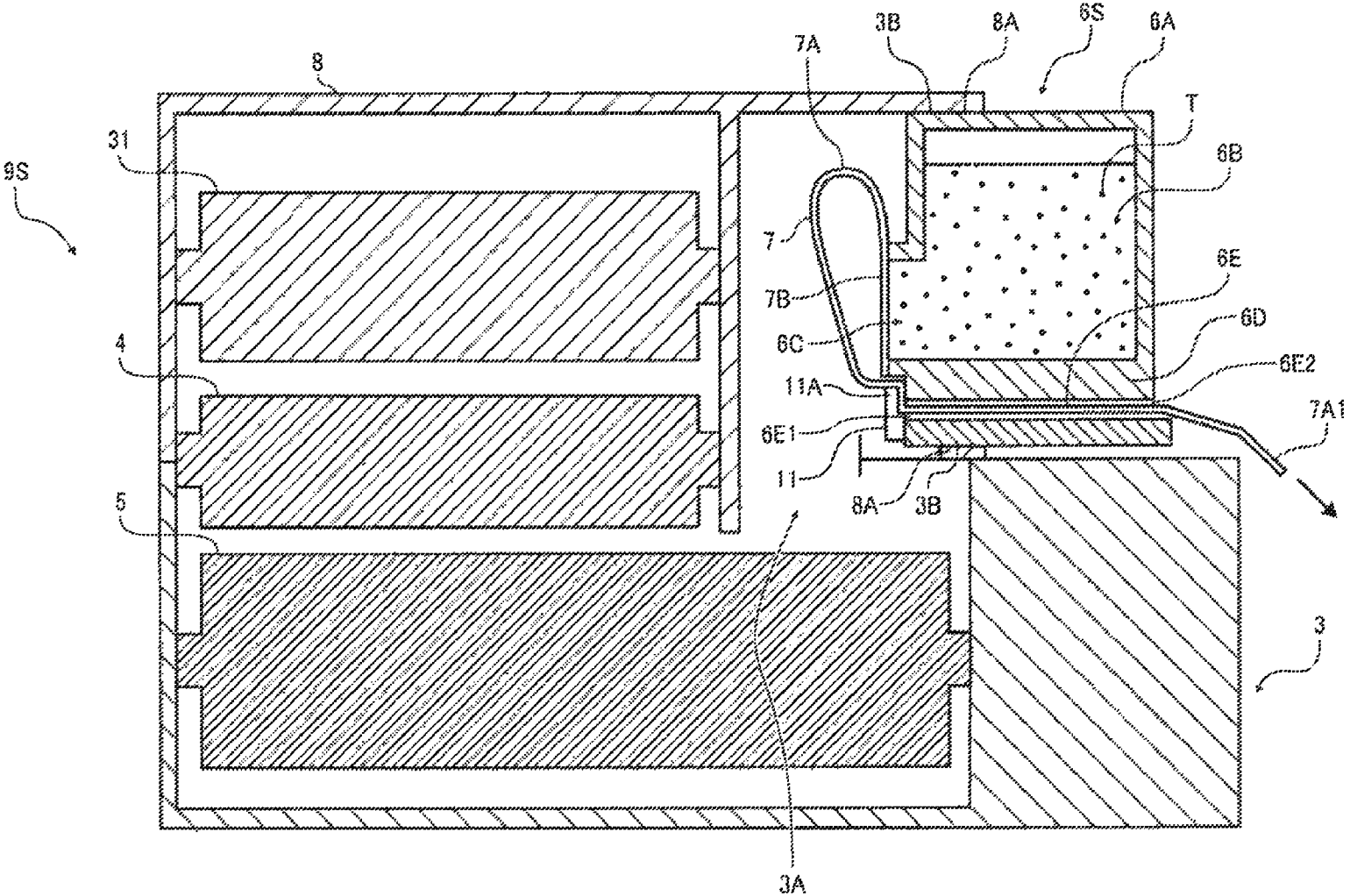
FIG. 6 is a sectional side view of a developer container according to another exemplary embodiment of the present invention.

FIG. 6 is a sectional side view of a process cartridge 9S including a developer container 6S according to another exemplary embodiment. The process cartridge 9S includes the frame 8, the photoconductor 31, the development device 3, and the developer container 6S. The developer container 6S includes the elements common to the developer container 6 depicted in FIG. 2. However, the second seal member 11 is not attached to the lead-out opening 6E2 but to the lead-in opening 6E1.

Figure 7:
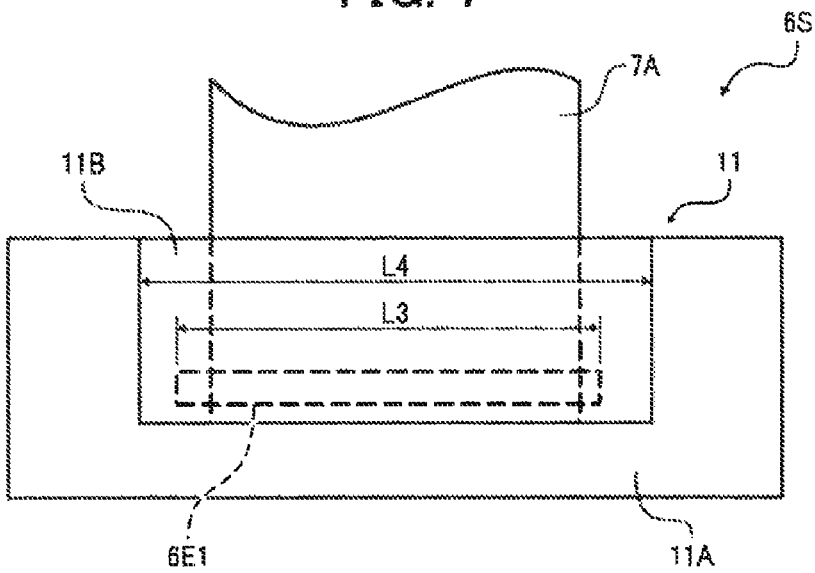
FIG. 7 is an enlarged front view of a second seal member included in the developer container shown in FIG. 6.
Figure 8:
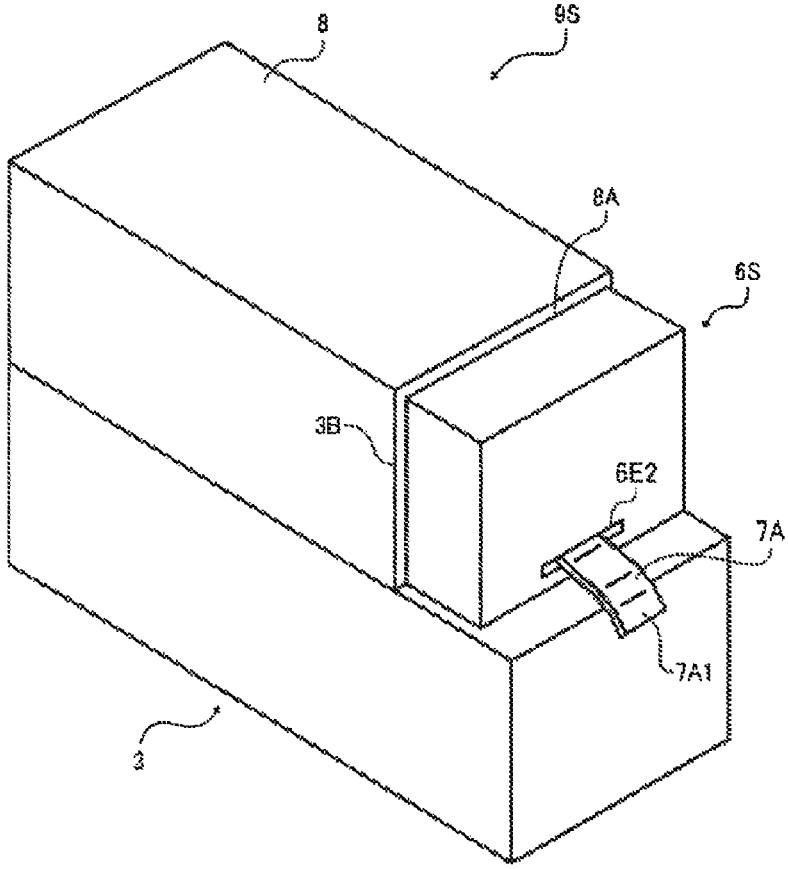
FIG. 8 is a perspective view of the developer container shown in FIG. 6.

FIG. 7 is an enlarged front view of the second seal member 11. FIG. 8 is a perspective view of the development device 3 and the developer container 6S.

As illustrated in FIG. 7, like in the developer container 6 depicted in FIG. 2, the second seal member 11 has an area larger than an area of the lead-in opening 6E1 of the through-hole 6E. The bonded portion 11A of the second seal member 11 is provided below and on the right and left of the lead-in opening 6E1 to have a U-like shape shaded in FIG. 7. In other words, the bonded portion 11A is bonded to a part of a periphery of the lead-in opening 6E1. Specifically, the bonded portion 11A is attached to a lower portion of the outer wall 6A (depicted in FIG. 6) of the developer container 6S, which is provided below the lead-in opening 6E1 of the through-hole 6E and both side portions of the outer wall 6A, which are provided on the right and left of the lead-in opening 6E1 of the through-hole 6E with an adhesive, for example. Namely, the bonded portion 11A partially surrounds the lead-in opening 6E1 of the through-hole 6E, and is fixed and bonded to the outer wall 6A of the developer container 6S. The non-bonded portion 11B of the second seal member 11 corresponds to an upper portion of the outer wall 6A of the developer container 6S, which is provided substantially on and above the lead-in opening 6E1 of the through-hole 6E, and is not attached to the upper portion of the outer wall 6A. The non-bonded portion 11B has a width L4 larger than a width L3 of the lead-in opening 6E1 of the through-hole 6E. When a user pulls out the tail end 7A1 exposed from the lead-out opening 6E2 through the through-hole 6E as illustrated in FIG. 8, the pull end 7A, which is provided between the non-bonded portion 11B and the outer wall 6A above the lead-in opening 6E1, can move flexibly. Accordingly, as illustrated in FIG. 6, when the pull end 7A and the seal portion 7B of the first seal member 7 are pulled out from the lead-in opening 6E1 to unseal the opening 6C, the non-bonded portion 11B elastically contacts the outer wall 6A of the developer container 6S above the lead-in opening 6E1 to seal the lead-in opening 6E1. Thus, the sealed lead-in opening 6E1 can prevent a developer T from leaking from the through-hole 6E to an outside of the developer container 6S through the lead-in opening 6E1.

As illustrated in FIG. 6, when the developer container 6S, in which the second seal member 11 is provided on the lead-in opening 6E1 of the through-hole 6E, is mounted on the development device 3, the second seal member 11 is located inside the development device 3 and thereby is not exposed to the outside of the developer container 6S. Therefore, the user may not accidentally remove the second seal member 11. Further, the user can omit an operation for checking the developer T staining the developer container 6S during maintenance, reducing a time period for maintenance.

In FIG. 7, a lower edge of the lead-in opening 6E1 is separated from the bonded portion 11A. Alternatively, the lower edge of the lead-in opening 6E1 may contact the bonded portion 11A.

Figure 9:
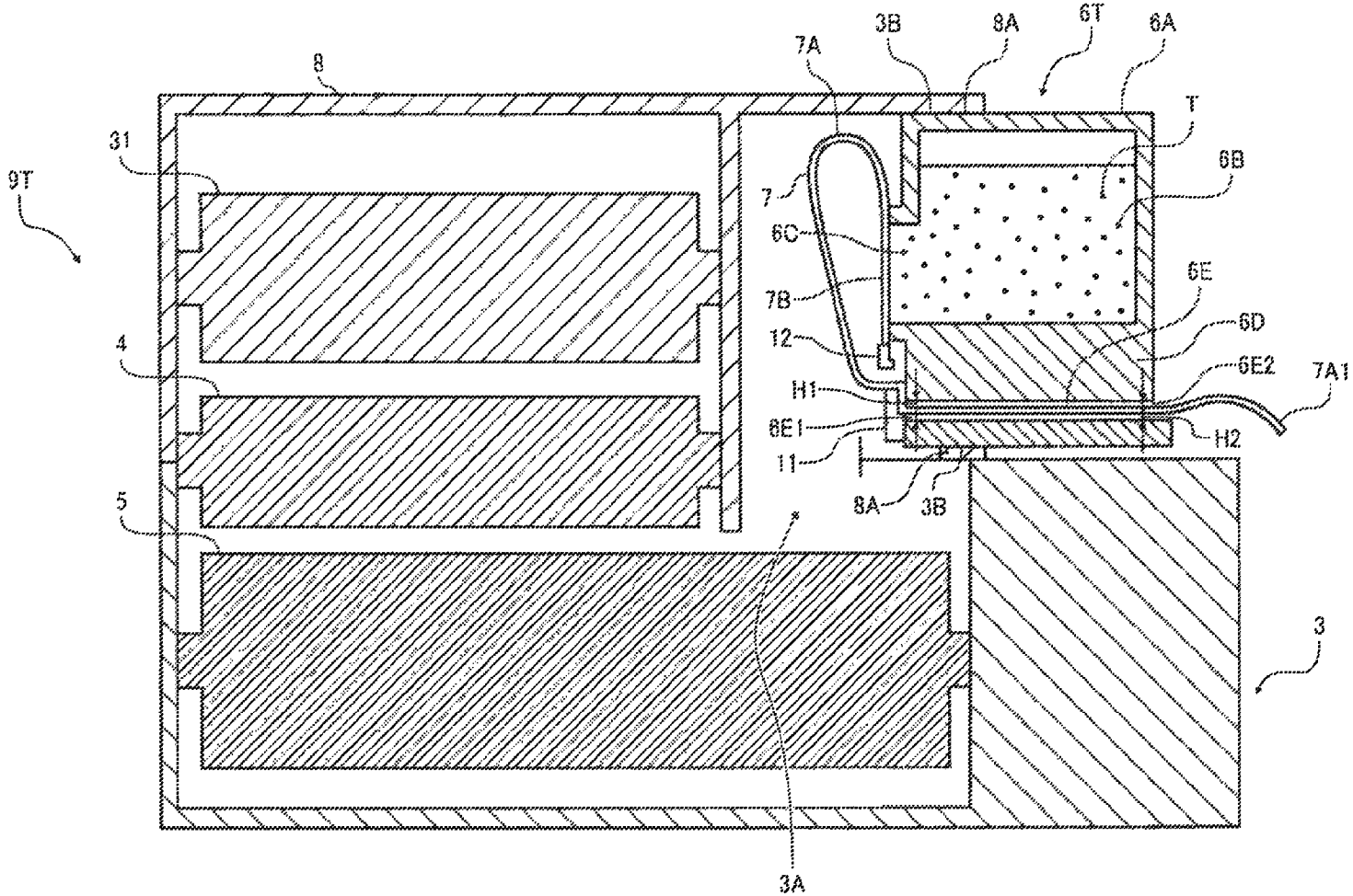
FIG. 9 is a sectional side view of a developer container according to yet another exemplary embodiment of the present invention.

FIG. 9 is a sectional side view of a process cartridge 9T including a developer container 6T according to yet another exemplary embodiment. The process cartridge 9T includes the frame 8, the photoconductor 31, the development device 3, and the developer container 6T. The developer container 6T includes a hook 12. The other elements of the developer container 6T are common to the developer container 6S depicted in FIG. 6.

Figure 10A:
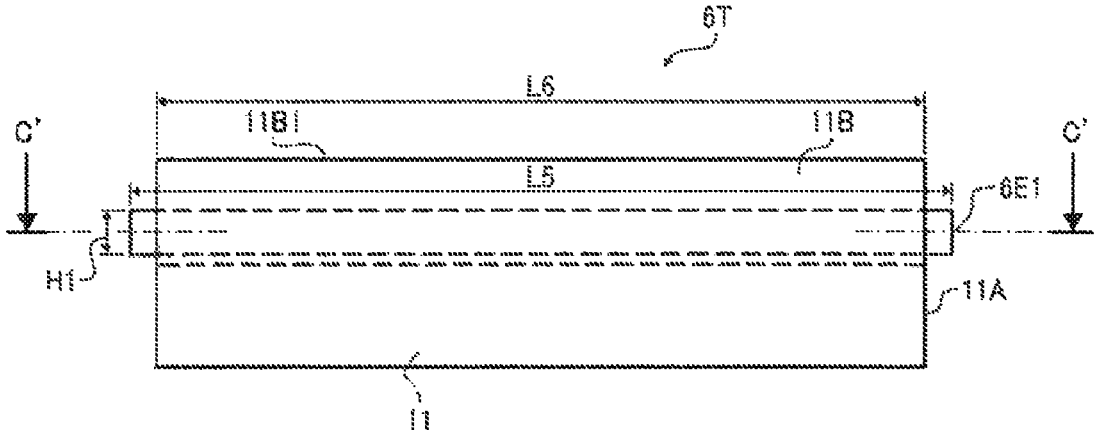
FIG. 10A is a sectional front view of a second seal member and a lead-in opening included in the developer container shown in FIG. 9.
Figure 10B:
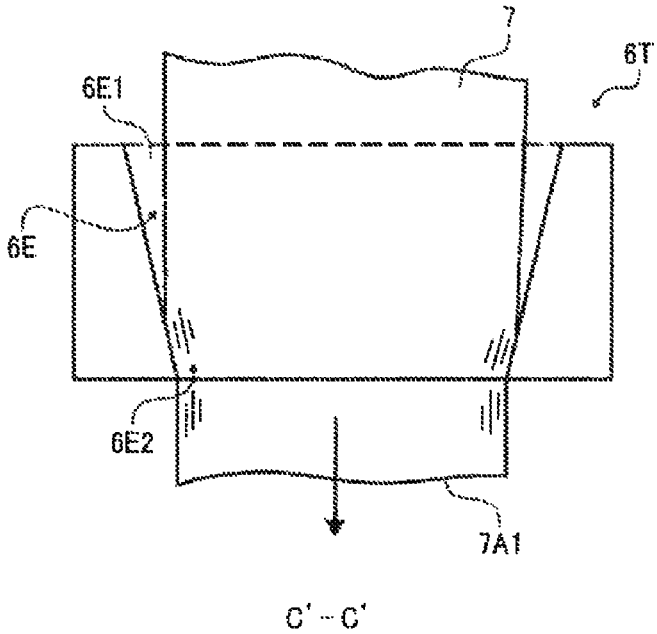
FIG. 10B is a sectional view of the developer container shown in FIG. 9 taken on line C'-C' in FIG. 10A.
Figure 11:
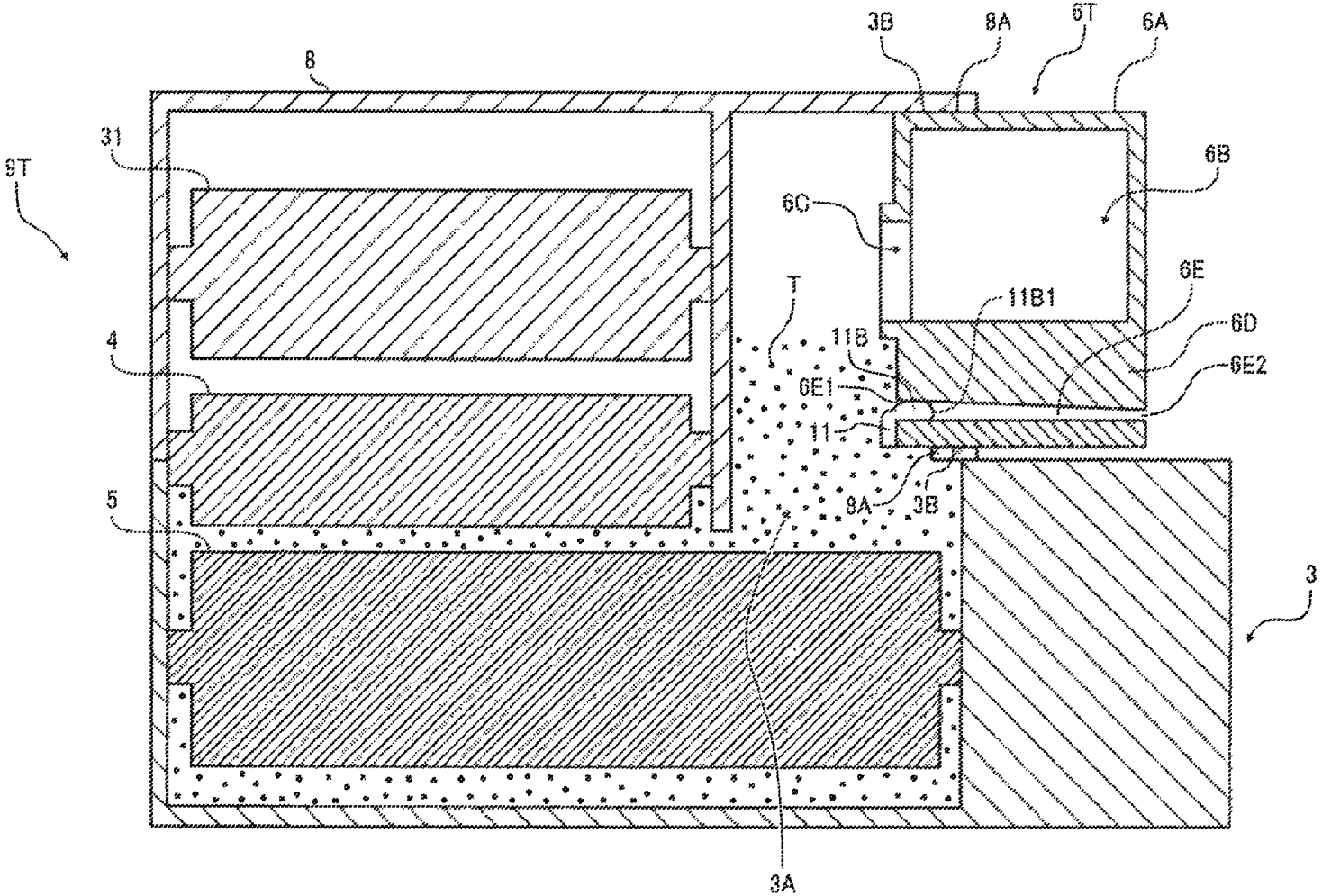
FIG. 11 is a sectional side view of the developer container shown in FIG. 9 when the second seal member shown in FIG. 10A seals the lead-in opening shown in FIG. 10A.

FIG. 10A is a sectional front view of the second seal member 11 and the lead-in opening 6E1. The non-bonded portion 11B includes an edge 11B1. FIG. 10B is a sectional view of the developer container 6T taken on line C'-C' in FIG. 10A. FIG. 11 is a sectional side view of the developer container 6T.

As illustrated in FIG. 9, in the developer container 6T, like in the developer container 6S, the second seal member 11 is attached to the outer wall 6A of the developer container 6T at an area near the lead-in opening 6E1. However, the developer container 6T is different from the developer container 6S, because the developer container 6T includes the hook 12 attached to a head end of the first seal member 7, that is, another end of the first seal member 7 provided opposite the tail end 7A1 via the pull end 7A and the seal portion 7B.

The hook 12 engages an edge of the non-bonded portion 11B (depicted in FIG. 10A) of the second seal member 11. Specifically, while the first seal member 7 passes through the edge of the non-bonded portion 11B of the second seal member 11 and is pulled out from the through-hole 6E, the hook 12 separates from a circumferential edge of the opening 6C and moves toward the edge of the non-bonded portion 11B of the second seal member 11 provided on the lead-in opening 6E1. When the hook 12 reaches the edge of the non-bonded portion 11B, the hook 12 engages the edge of the non-bonded portion 11B and guides the non-bonded portion 11B into the through-hole 6E. Namely, at least a part of the non-bonded portion 11B of the second seal member 11 is inserted into the through-hole 6E to block the through-hole 6E.

As illustrated in FIG. 10A, the second seal member 11 has a width L6 smaller than a width L5 of the lead-in opening 6E1 of the through-hole 6E and has a width larger than the width L1 of the lead-out opening 6E2 depicted in FIG. 4. The bonded portion 11A is attached to a lower portion of the outer wall 6A of the developer container 6T, which is provided below the lead-in opening 6E1 of the through-hole 6E. In other words, the bonded portion 11A is provided below the lead-in opening 6E1 of the through hole 6E and parallel to a lower edge of the lead-in opening 6E1. The non-bonded portion 11B is provided on an upper portion of the outer wall 6A, which is provided substantially on and above the lead-in opening 6E1 of the through-hole 6E. The non-bonded portion 11B is not attached to the outer wall 6A. The width L5 of the lead-in opening 6E1 is greater than the width L1 of the lead-out opening 6E2 depicted in FIG. 4. A height H1 of the lead-in opening 6E1 is also greater than a height H2 of the lead-out opening 6E2 depicted in FIG. 9. Namely, the through-hole 6E has a wedge-like shape in which the width and the height of the through-hole 6E gradually become smaller from the lead-in opening 6E1 toward the lead-out opening 6E2.

FIG. 10B illustrates a plane view of the through-hole 6E having a taper shape. When a user pulls out the first seal member 7 inserted in the through-hole 6E from the lead-out opening 6E2, the first seal member 7, which has a width larger than the width L1 of the lead-out opening 6E2, is contacted by inner walls of the lead-out opening 6E2 and thereby compressed in a width direction of the first seal member 7. Accordingly, toner particles adhered to the first seal member 7 are scraped down in the through-hole 6E near the lead-out opening 6E2 and thereby do not leak out from the through-hole 6E.

As illustrated in FIG. 10A, left and right edges of the lead-in opening 6E1 protrude from left and right edges of the non-bonded portion 11B, respectively. Alternatively, the left and right edges of the lead-in opening 6E1 may not protrude from the left and right edges of the non-bonded portion 11B, respectively. For example, the left and right edges of the lead-in opening 6E1 may be aligned with or recessed from the left and right edges of the non-bonded portion 11B.

As illustrated in FIG. 10A, a lower edge of the lead-in opening 6E1 is separated from an upper edge of the bonded portion 11A. Alternatively, the lower edge of the lead-in opening 6E1 may contact the upper edge of the bonded portion 11A.

As illustrated in FIG. 9, when the user pulls the tail end 7A1 of the first seal member 7 to unseal the opening 6C, the hook 12 attached to the head end of the first seal member 7 moves while engaging the edge 11B1 (depicted in FIG. 10A) of the non-bonded portion 11B of the second seal member 11. The moving first seal member 7 inserts the edge 11B1 of the second seal member 11 into the through-hole 6E as illustrated in FIG. 11. The edge 11B1 of the non-bonded portion 11B of the second seal member 11 elastically contacts inner circumferential walls of the through-hole 6E having the wedge-like shape in which the width and the height of the through-hole 6E gradually become smaller from the lead-in opening 6E1 toward the lead-out opening 6E2, so as to seal the through-hole 6E. In other words, the hook 12 inserts the non-bonded portion 11B of the second seal member 11 into the through-hole 6E so that the non-bonded portion 11B seals the through-hole 6E. Therefore, even when the second seal member 11 is not properly attached on the lead-in opening 6E1 of the through-hole 6E, for example, even when the second seal member 11 is shifted from the lead-in opening 6E1, the second seal member 11 can properly seal the through-hole 6E.

Further, as illustrated in FIG. 10A, the width L5 of the lead-in opening 6E1 of the through-hole 6E is larger than the width L6 of the non-bonded portion 11B of the second seal member 11. Thus, the non-bonded portion 11B can be inserted into the through-hole 6E through the lead-in opening 6E1 easily.

Figure 12:
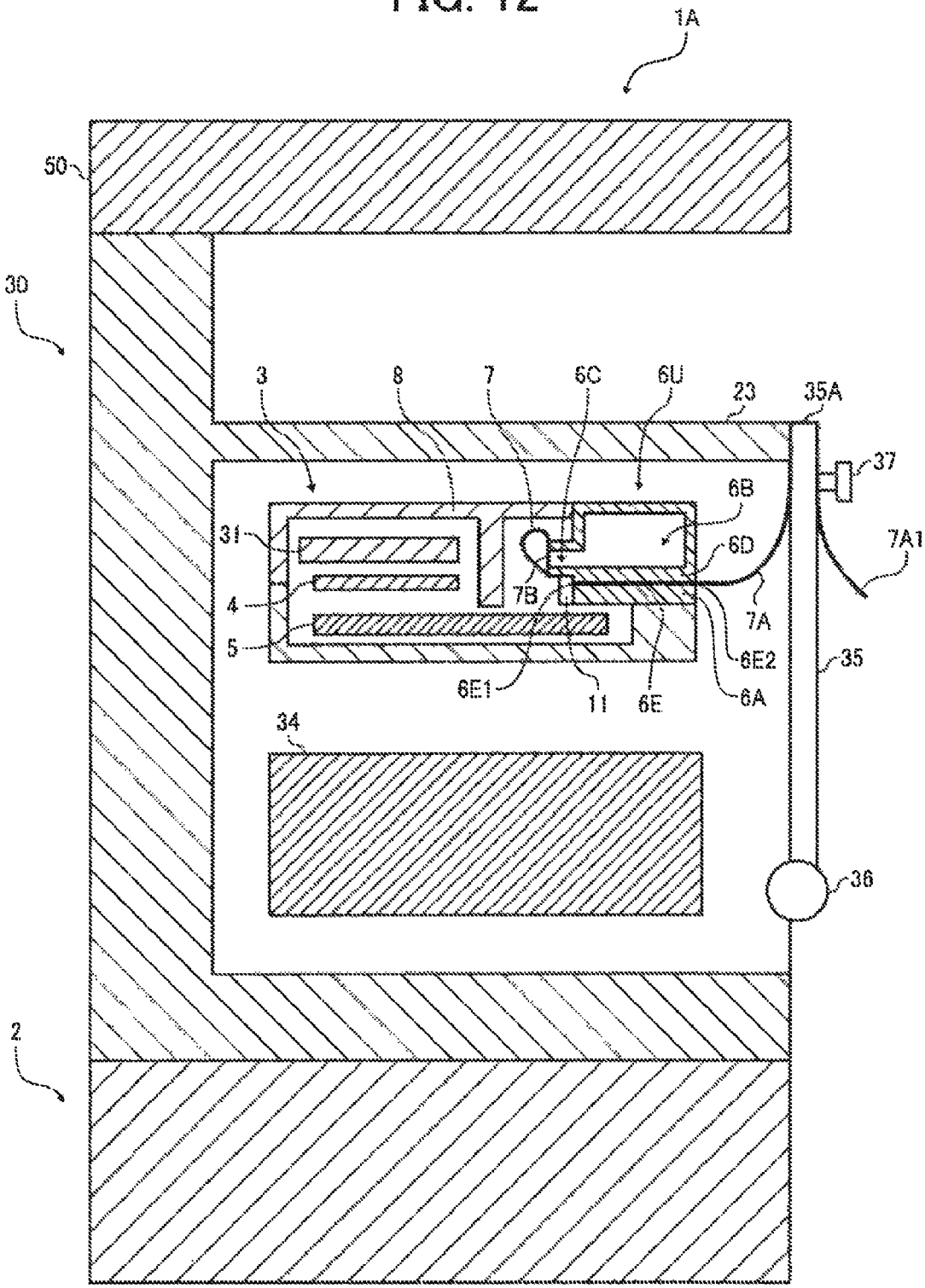
FIG. 12 is a schematic sectional view of an image forming apparatus according to yet another exemplary embodiment of the present invention.

Referring to FIG. 12, the following describes an image forming apparatus 1A according to yet another exemplary embodiment. FIG. 12 is a schematic sectional view of the image forming apparatus 1A. The image forming apparatus 1A includes an image reader 50, a developer container 6U instead of the developer container 6 depicted in FIG. 1, a cover 35, a support shaft 36, and an engaging member 37. The cover 35 includes an upper end 35A. The other elements of the image forming apparatus 1A are common to the image forming apparatus 1 depicted in FIG. 1.

The image forming device 30 is provided in a center portion of the image forming apparatus 1A. The sheet supply device 2 is provided below the image forming device 30. The image reader 50 is provided above the image forming device 30. The image forming device 30 includes the photoconductor 31, the development device 3, a charger, a cleaner, and the exposure device 34. The photoconductor 31 and the development device 3 are integrated into a unit. Like in the image forming apparatus 1 depicted in FIG. 1, the charger uniformly charges the surface of the photoconductor 31. The exposure device 34 forms an electrostatic latent image on the surface of the photoconductor 31. The development device 3 supplies toner particles to the electrostatic latent image formed on the surface of the photoconductor 31 to form a toner image on the surface of the photoconductor 31. A transfer roller transfers the toner image formed on the surface of the photoconductor 31 onto a transfer sheet supplied by the sheet supply device 2. A fixing device fixes the toner image on the transfer sheet. The transfer sheet bearing the fixed toner image is output onto the output tray 23.

The developer container 6U is attached to an engaging portion of the frame 8 in such a manner that the developer container 6U is attachable to and detachable from the frame 8. The seal portion 7B of the first seal member 7 is attached to the opening 6C of the developer container 6U to seal the opening 6C. The through-hole 6E provided in the bottom wall 6D of the developer container 6U guides the pull end 7A extending from an end of the seal portion 7B to an outlet (e.g., the lead-out opening 6E2) provided at a side of the developer container 6U opposite to the opening 6C, so that the pull end 7A gets out of the through-hole 6E via the outlet.

The cover 35 rotates about the support shaft 36, and is opened and closed with respect to the image forming device 30. The tail end 7A1 of the pull end 7A surmounts the upper end 35A (e.g., a free end) of the cover 35, and is exposed to an outside of the image forming apparatus 1A. The tail end 7A1 of the pull end 7A engages the engaging member 37 provided on the cover 35. Accordingly, when a user visually checks that the tail end 7A1 of the pull end 7A of the first seal member 7 engages the engaging member 37 provided on the cover 35, the user can easily recognize that the first seal member 7 is not pulled out from the developer container 6U and thereby the opening 6C is not opened yet. In other words, the user does not forget to pull out the first seal member 7 when the new developer container 6U is installed in the image forming apparatus 1A.

According to this exemplary embodiment, like in the developer container 6S depicted in FIG. 6, the second seal member 11 is provided on the lead-in opening 6E1 of the through-hole 6E. When the user pulls out the first seal member 7 to unseal the opening 6C, the non-bonded portion 11B (depicted in FIG. 7) of the second seal member 11 elastically seals the through-hole 6E to prevent a developer from leaking from the development device 3.

Figure 13:
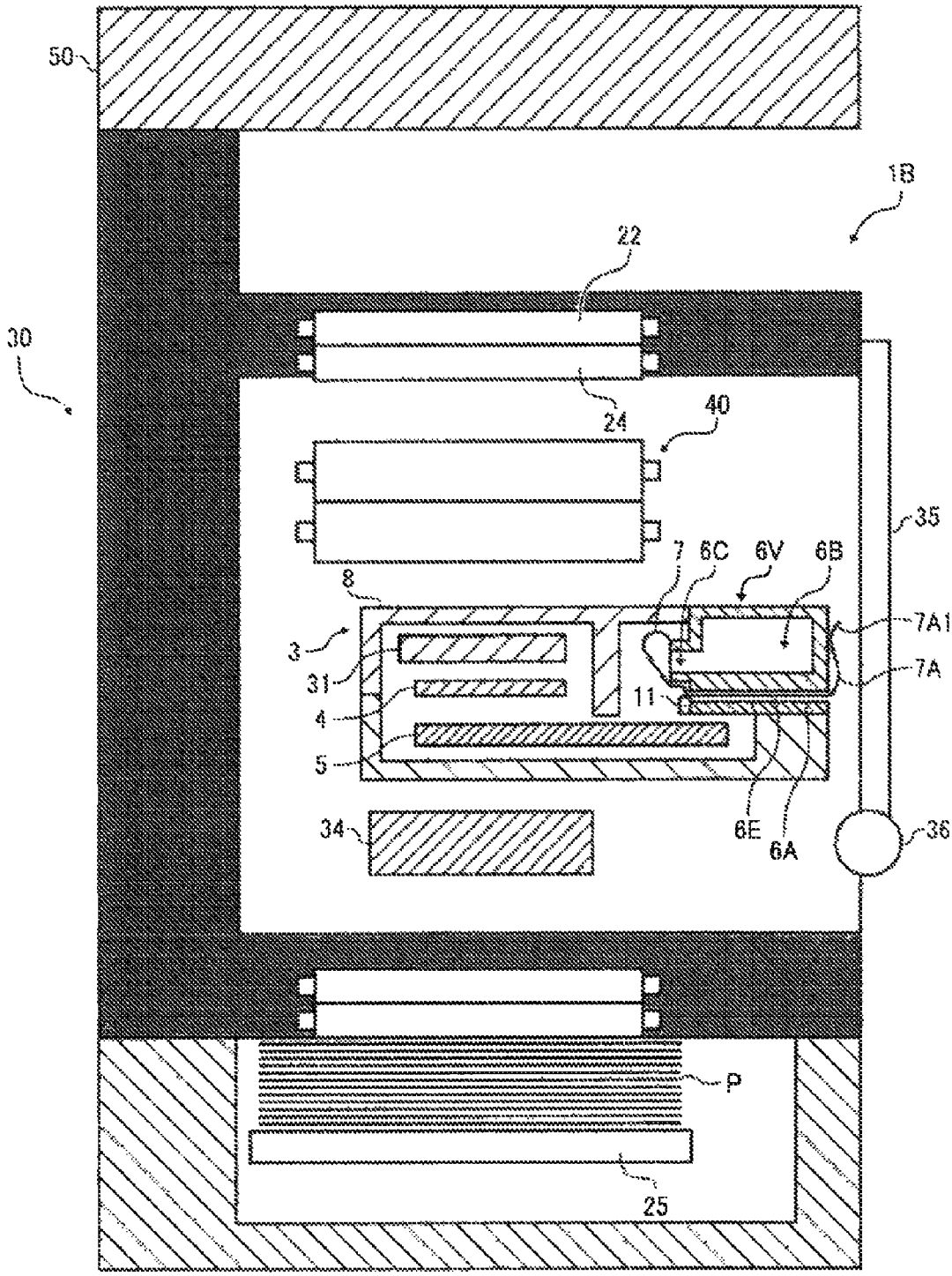
FIG. 13 is a schematic sectional view of an image forming apparatus according to yet another exemplary embodiment of the present invention.
Figure 14:
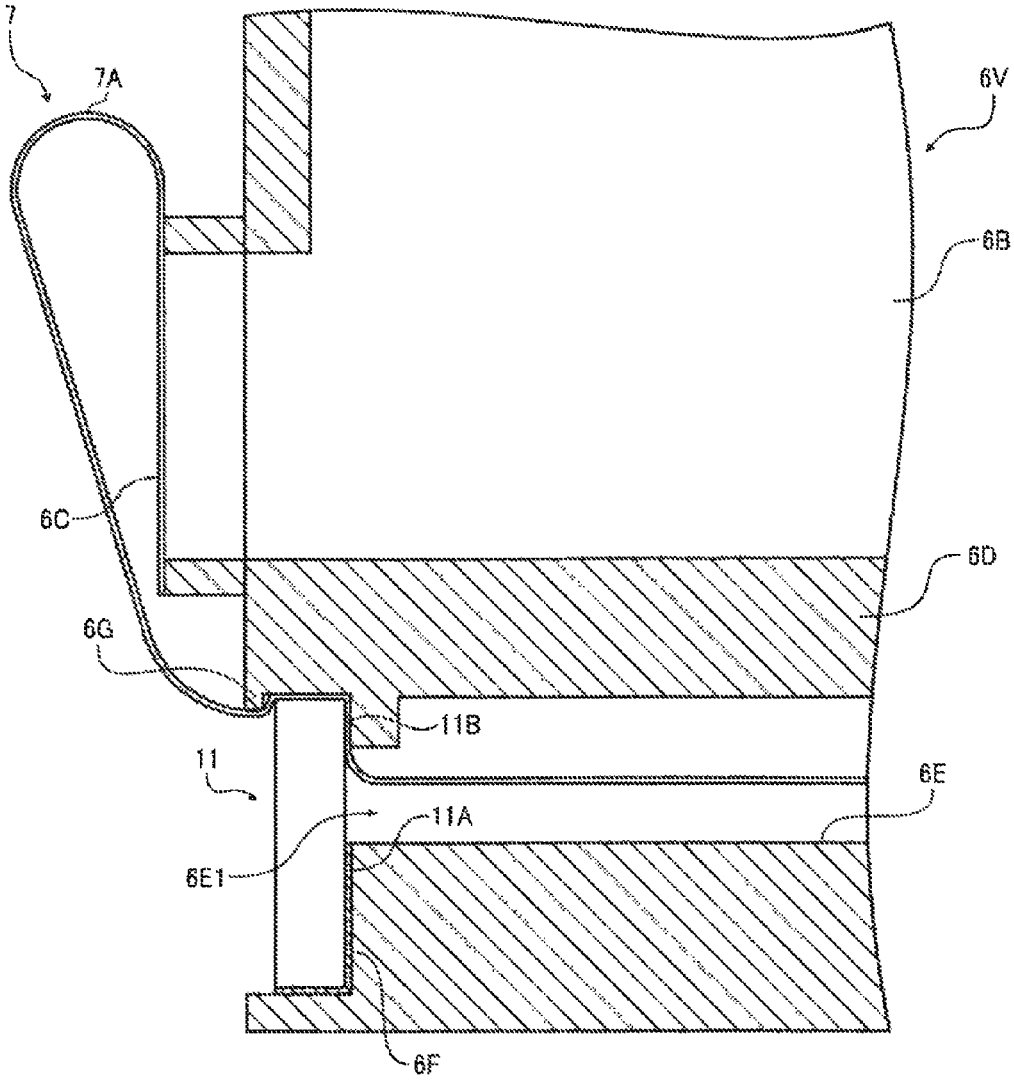
FIG. 14 is a sectional view of a developer container included in the image forming apparatus shown in FIG. 13.

Referring to FIGS. 13 and 14, the following describes an image forming apparatus 1B according to yet another exemplary embodiment. FIG. 13 is a schematic sectional view of the image forming apparatus 1B. The image forming apparatus 1B includes a developer container 6V instead of the developer container 6U depicted in FIG. 12 and does not include the engaging member 37 depicted in FIG. 12. The other elements of the image forming apparatus 1B are common to the image forming apparatus 1A depicted in FIG. 12.

FIG. 14 is a sectional view of the developer container 6V. The developer container 6V includes a concave portion 6F and a flange portion 6G.

As illustrated in FIG. 14, in the developer container 6V, the concave portion 6F (e.g., a step) is provided in the bottom wall 6D of the storage 6B at a position lower than the opening 6C of the storage 6B. The lead-in opening 6E1 of the through-hole 6E is provided on an innermost wall of the concave portion 6F. The second seal member 11 engages the concave portion 6F.

As illustrated in FIG. 13, unlike in the image forming apparatus 1A depicted in FIG. 12, the tail end 7A1 of the pull end 7A pulled out from the through-hole 6E to an outside of the developer container 6V is provided inside the cover 35.

The first seal member 7, the second seal member 11, and the through-hole 6E of the developer container 6V may have the structures described in any of the above exemplary embodiments. For example, the bonded portion 11A of the second seal member 11 may be provided below and on the right and left of the lead-out opening 6E2 to have the U-like shape as illustrated in FIG. 4. Alternatively, the bonded portion 11A of the second seal member 11 may be provided below and on the right and left of the lead-in opening 6E1 to have the U-like shape as illustrated in FIG. 7. Yet alternatively, the bonded portion 11A of the second seal member 11 may be provided below and on the right and left of each of the lead-in opening 6E1 and the lead-out opening 6E2. Yet alternatively, the bonded portion 11A of the second seal member 11 may be provided along the lower edge of at least one of the lead-in opening 6E1 and the lead-out opening 6E2 as illustrated in FIG. 10A.

As illustrated in FIG. 14, the second seal member 11 has a rectangular plate shape slightly larger than a rectangle formed by four inner walls of the concave portion 6F. Accordingly, when the second seal member 11 is inserted into the concave portion 6F, the second seal member 11 elastically contacts the four inner walls of the concave portion 6F. Consequently, when the opening 6C is opened, toner particles do not leak from the through-hole 6E. Further, when a user pulls out the first seal member 7, a surface of the first seal member 7 bearing toner particles slides on the second seal member 11 to effectively remove the toner particles adhered to the surface of the first seal member 7 from the first seal member 7. An upper edge of the second seal member 11 engaged with the concave portion 6F is provided at a position higher than an upper edge of the through-hole 6E. In other words, the second seal member 11 overlaps the concave potion 6F. Thus, the second seal member 11 can block the through-hole 6E to prevent toner particles from leaking from the through-hole 6E. Moreover, when the first seal member 7 is pulled out, the second seal member 11 can remove toner particles from the first seal member 7. Namely, even when the first seal member 7 applies tension to deform the upper edge of the second seal member 11, for example, even when the first seal member 7 bends the second seal member 11 downward or pushes down the second seal member 11, the upper edge of the second seal member 11 provided at the position higher than the through-hole 6E prevents a large space from being formed between the upper edge of the second seal member 11 and an upper inner wall of the concave portion 6F. Accordingly, the through-hole 6E is not exposed.

In other words, the second seal member 11 engages the concave portion 6F and at least the upper edge of the second seal member 11 pressingly contacts the upper inner wall of the concave portion 6F, so as to prevent toner particles from leaking from the through-hole 6E.

The bonded portion 11A of the second seal member 11, at which the second seal member 11 is adhered to the innermost wall of the concave portion 6F, is provided at a position lower than a lower edge of the through-hole 6E. The bonded portion 11A may be adhered to a lower inner wall of the concave portion 6F in addition to the innermost wall of the concave portion 6F. Specifically, a lower surface of the second seal member 11 may be adhered to the lower inner wall of the concave portion 6F.

An outer surface of the second seal member 11 does not protrude from the concave portion 6F toward an outside of the developer container 6V. In other words, the concave portion 6F cases the second seal member 11. Accordingly, when the user pulls out the first seal member 7 to unseal the opening 6C, toner particles falling down from the opening 6C do not adhere to an upper surface or the outer surface of the second seal member 11. When the toner particles are accumulated on the upper surface of the second seal member 11, weight of the accumulated toner particles may bend the upper surface of the second seal member 11 and thereby a space may be formed between the bent upper surface of the second seal member 11 and the upper inner wall of the concave portion 6F. Consequently, the toner particles may move from the space into the through-hole 6E. However, according to this exemplary embodiment, the toner particles do not accumulate on the upper surface of the second seal member 11, preventing the toner particles from moving into the through-hole 6E.

As illustrated in FIG. 14, the flange portion 6G protrudes downward from the upper edge of the concave portion 6F to cover an upper outer portion of the second seal member 11 provided in the concave portion 6F. Thus, even when the user pulls out the first seal member 7 to unseal the opening 6C, the flange portion 6G prevents toner particles falling down from the opening 6C from adhering to the second seal member 11. For example, the flange portion 6G overlaps the upper outer portion of the second seal member 11 to prevent a developer containing toner particles from leaking from between the upper edge of the second seal member 11 and the upper inner wall of the concave portion 6F. Accordingly, the upper surface of the second seal member 11 needs not contact the upper inner wall of the concave potion 6F with an increased pressure. Further, the flange portion 6G can scrape toner particles adhered to the first seal member 7 when the user pulls out the first seal member 7. Alternatively, the flange portion 6G may be provided on an edge other than the upper edge of the concave portion 6F. Yet alternatively, the flange portion 6G may be formed of a thin plate material including PET (polyethylene terephtalate) and may be attached to the upper inner wall of the concave portion 6F.

Figure 15:
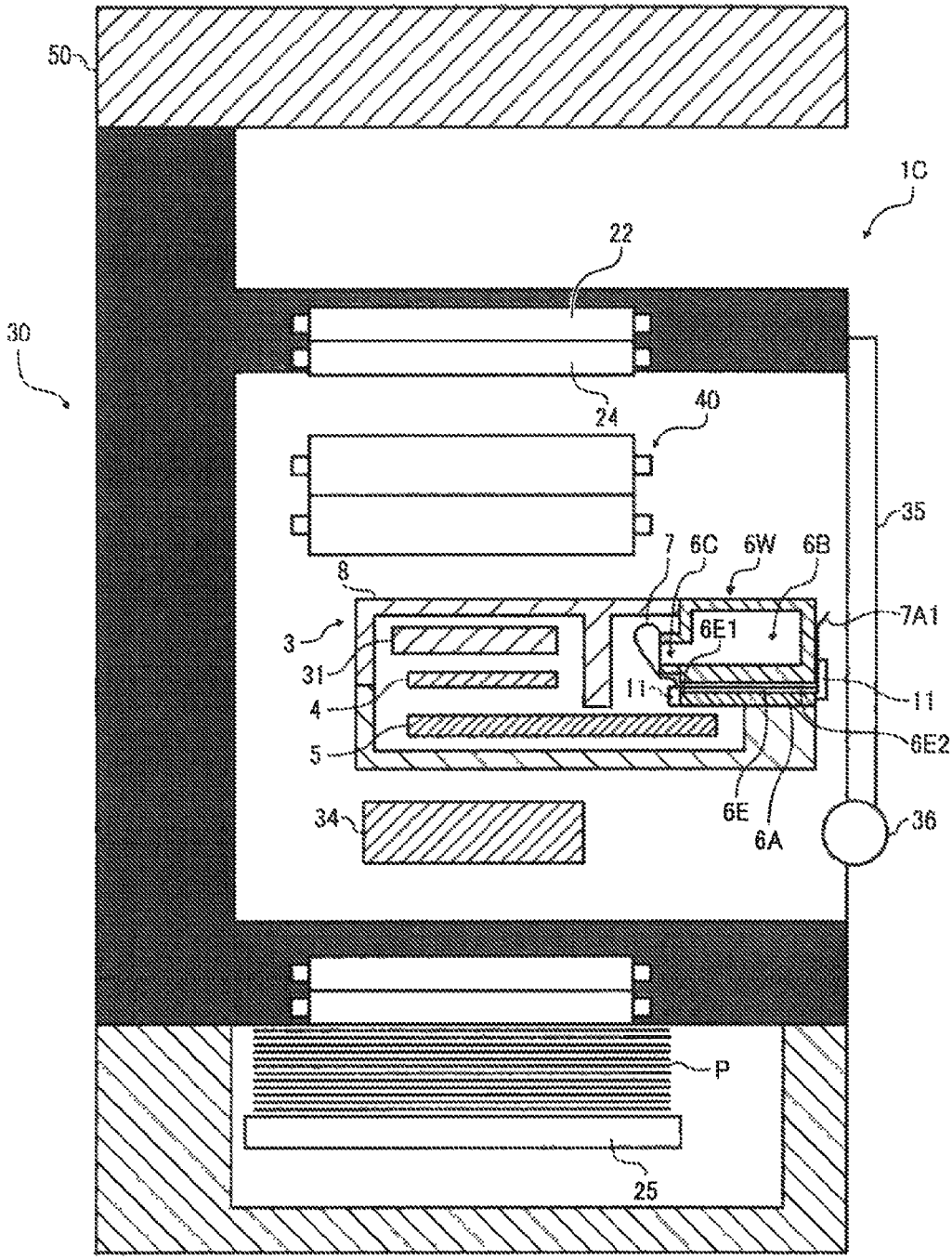
FIG. 15 is a schematic sectional view of an image forming apparatus according to yet another exemplary embodiment of the present invention.

Referring to FIG. 15, the following describes an image forming apparatus 1C according to yet another exemplary embodiment. FIG. 15 is a schematic sectional view of the image forming apparatus 1C. The image forming apparatus 1C includes a developer container 6W instead of the developer container 6V depicted in FIG. 13. The other elements of the image forming apparatus 1C are common to the image forming apparatus 1B depicted in FIG. 13.

The developer container 6W is a modified example of the developer container 6 depicted in FIG. 2, the developer container 6S depicted in FIG. 6, the developer container 6T depicted in FIG. 9, the developer container 6U depicted in FIG. 12, and the developer container 6V depicted in FIG. 13.

In the developer container 6W, the second seal members 11 are provided on the lead-in opening 6E1 and the lead-out opening 6E2 of the through-hole 6E, respectively, to prevent a developer containing toner particles from leaking from the through-hole 6E more effectively when a user pulls out the first seal member 7. For example, even when toner particles enter the through-hole 6E through the lead-in opening 6E1, the second seal member 11 provided on the lead-out opening 6E2 prevents the toner particles from leaking from the through-hole 6E to an outside of the developer container 6W.

The bonded portion 11A of the second seal member 11 may be provided below and on the right and left of each of the lead-in opening 6E1 and the lead-out opening 6E2 to have the U-like shape as illustrated in FIGS. 4 and 7. Alternatively, the bonded portion 11A of the second seal member 11 may be provided along each of the lower edge of the lead-in opening 6E1 and the lead-out opening 6E2 as illustrated in FIG. 10A.

A reinforcing film, such as a PET sheet, may be attached to at least a part of a surface of the second seal member 11 so that the reinforcing film is integrated with the second seal member 11 to enhance shape retention of the second seal member 11. For example, the upper edge of the second seal member 11 is easily bent or deformed by tension applied by the first seal member 7. To address this, the reinforcing film reinforces the second seal member 11, especially, an outer surface of the upper edge of the second seal member 11 to prevent the upper edge of the second seal member 11 from being bent downward to expose the through-hole 6E. Further, the reinforcing film can prevent leakage of toner particles even when the second seal member 11 does not have an outside dimension substantially larger than an inside dimension of the concave portion 6F (depicted in FIG. 14).

The reinforcing film may be attached to the surface of the second seal member 11 partially or wholly in a vertical direction and a horizontal direction.

Figure 16:
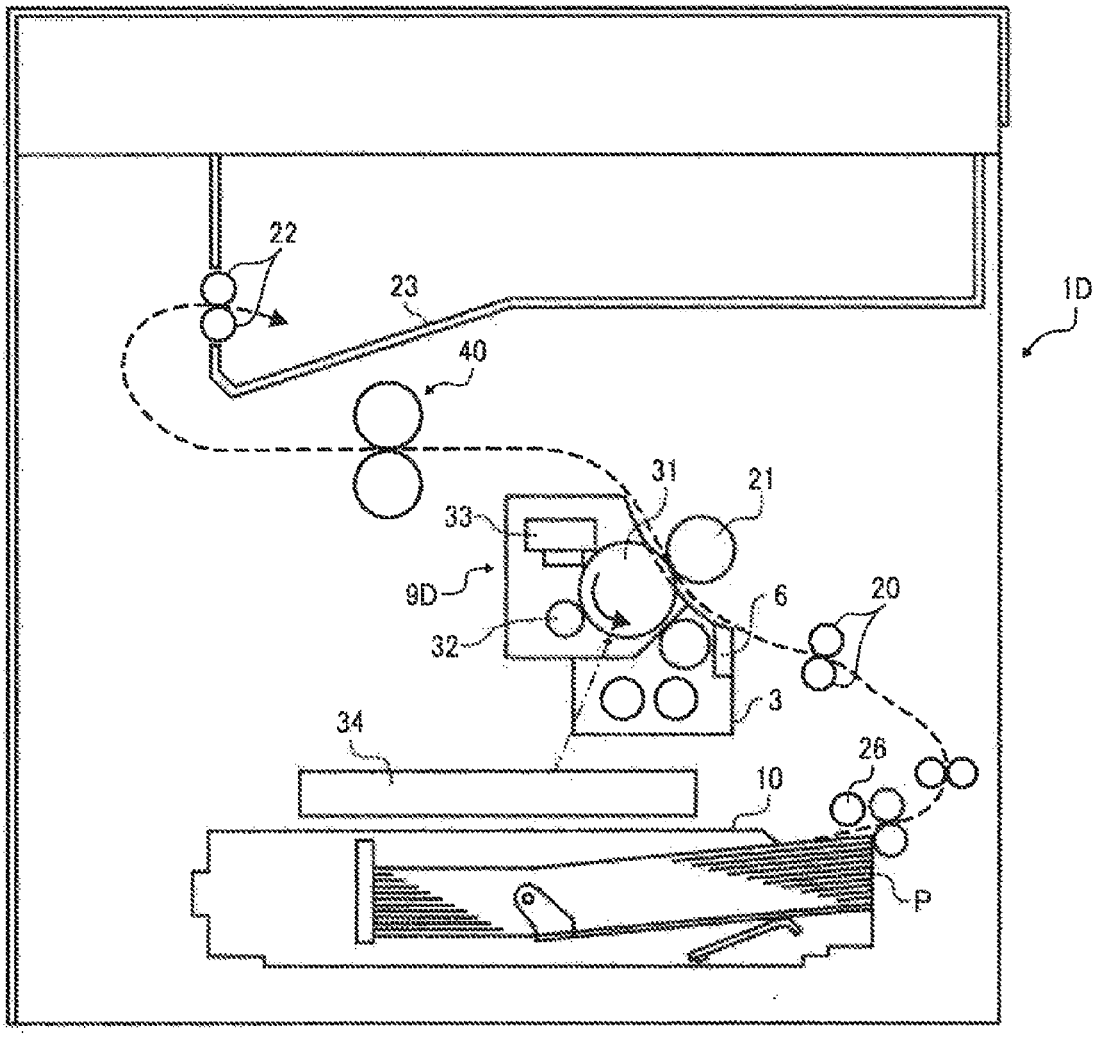
FIG. 16 is a schematic sectional view of an image forming apparatus according to yet another exemplary embodiment of the present invention.

Referring to FIG. 16, the following describes an image forming apparatus 1D according to yet another exemplary embodiment. FIG. 16 is a schematic sectional view of the image forming apparatus 1D. The image forming apparatus 1D includes a process cartridge 9D instead of the process cartridge 9 depicted in FIG. 1. The other elements of the image forming apparatus 1D are common to the image forming apparatus 1 depicted in FIG. 1.

The process cartridge 9D includes the photoconductor 31, the development device 3, the charger 32, the cleaner 33, and the developer container 6. The developer container 6 is attachable to and detachable from the development device 3. Alternatively, the process cartridge 9D may include the developer container 6S depicted in FIG. 6, the developer container 6T depicted in FIG. 9, the developer container 6U depicted in FIG. 12, the developer container 6V depicted in FIG. 13, or the developer container 6W depicted in FIG. 15.

As illustrated in FIG. 2, according to the above-described exemplary embodiments, in the developer container 6, 6S, 6T, 6U, 6V, or 6W, the first seal member 7 seals the opening 6C, and includes the seal portion 7B for sealing the opening 6C and the pull end 7A combined with the seal portion 7B. When a user pulls the pull end 7A in a predetermined direction, the seal portion 7B unseals the opening 6C. The through-hole 6E is provided in a part of an outer circumference of the storage 6B, and guides the pull end 7A to a side of the developer container 6 opposite to the opening 6C. The second seal member 11 is provided on at least one of the lead-in opening 6E1 and the lead-out opening 6E2 of the through-hole 6E through which the pull end 7A enters and gets out of the through-hole 6E. The second seal member 11 elastically seals the at least one of the lead-in opening 6E1 and the lead-out opening 6E2. The second seal member 11 includes the bonded portion 11A (depicted in FIGS. 4, 7, and 10A) attached to a part of a periphery of the at least one of the lead-in opening 6E1 and the lead-out opening 6E2. The second seal member 11 further includes the non-bonded portion 11B (depicted in FIGS. 4, 7, and 10A) not attached to the periphery of the at least one of the lead-in opening 6E1 and the lead-out opening 6E2 to allow the first seal member 7 to move on the second seal member 11. When the first seal member 7 is pulled out from the through-hole 6E through the non-bonded portion 11B, the non-bonded portion 11B elastically blocks the at least one of the lead-in opening 6E1 and the lead-out opening 6E2. Thus, the engaging portion 3B at which the development device 3 engages the developer container 6 can be flexibly shaped. Further, the developer container 6 and the image forming apparatus 1 (depicted in FIG. 1) including the developer container 6 can provide proper sealing with respect to a developer and usability for the user.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A developer container for supplying developer to a development device, the developer container comprising:

a storage configured to store the developer;

an opening through which the developer is supplied from the storage to the development device;

a first seal member configured to seal the opening, the first seal member comprising:

a seal portion configured to seal the opening; and a pull end provided on one end of the first seal member and combined with the seal portion, the pull end configured to be pulled in a predetermined direction to unseal the opening;

a through-hole provided in a wall of the storage and configured to guide the pull end of the first seal member toward an opposite side of the opening, the through-hole comprising:

a lead-in opening configured to lead the pull end of the first seal member into the through-hole; and a lead-out opening configured to lead the pull end of the first seal member out from the through-hole; and a second seal member provided on at least one of the lead-in opening and the lead-out opening of the through-hole and configured to elastically block the at least one of the lead-in opening and the lead-out opening, the second seal member comprising:

a bonded portion bonded to a part of a periphery of the at least one of the lead-in opening and the lead-out opening; and a non-bonded portion not bonded to the periphery of the at least one of the lead-in opening and the lead-out opening and configured to allow the first seal member to move on the non-bonded portion, the non-bonded portion configured to elastically block the at least one of the lead-in opening and the lead-out opening when the first seal member is pulled out from the through-hole through the non-bonded portion, wherein the first seal member further comprises a hook provided on another end of the first seal member opposite the pull end via the seal portion, and configured to engage an edge of the non-bonded portion of the second seal member, and wherein, while the first seal member is pulled out from the through-hole through the edge of the non-bonded portion of the second seal member, the hook of the first seal member engages the edge of the non-bonded portion of the second seal member and inserts at least a part of the non-bonded portion of the second seal member into the through-hole to block the through-hole.

2. The developer container according to claim 1, wherein a width and a height of the lead-in opening of the through-hole are larger than a width and a height of the lead-out opening of the through-hole.

3. The developer container according to claim 1, wherein the bonded portion of the second seal member partially surrounds the at least one of the lead-in opening and the lead-out opening of the through-hole to have a U-like shape.

4. The developer container according to claim 1, wherein the bonded portion of the second seal member is provided below the at least one of the lead-in opening and the lead-out opening of the through-hole and parallel to a lower edge of the at least one of the lead-in opening and the lead-out opening of the through-hole.

5. The developer container according to claim 1, wherein an upper edge of the second seal member is positioned higher than an upper edge of the lead-in opening of the through-hole.

6. The developer container according to claim 1, further comprising:

a concave portion provided in the wall of the storage, wherein the lead-in opening of the through-hole is provided on an innermost wall of the concave portion and the second seal member engages the concave portion.

7. The developer container according to claim 6, wherein the second seal member is pressingly inserted in the concave portion to elastically contact inner walls of the concave portion.

8. The developer container according to claim 6, further comprising:

a flange portion provided on an upper edge of the concave portion and configured to cover an upper outer portion of the second seal member provided in the concave portion.

9. The developer container according to claim 1, wherein a reinforcing film is provided on a surface of the second seal member and is integrated with the second seal member.

10. An image forming apparatus, comprising:

a photoconductor configured to carry an electrostatic latent image;

a development device configured to supply developer to the electrostatic latent image formed on the photoconductor to develop the electrostatic latent image; and a developer container detachably attachable to the development device and configured to supply the developer to the development device, the developer container comprising:

a storage configured to store the developer;

an opening through which the developer is supplied from the storage to the development device;

a first seal member configured to seal the opening, the first seal member comprising:

a seal portion configured to seal the opening; and a pull end provided on one end of the first seal member and combined with the seal portion, the pull end configured to be pulled in a predetermined direction to unseal the opening;

a through-hole provided in a wall of the storage and configured to guide the pull end of the first seal member toward an opposite side of the opening, the through-hole comprising:

a lead-in opening configured to lead the pull end of the first seal member into the through-hole; and a lead-out opening configured to lead the pull end of the first seal member out from the through-hole; and a second seal member provided on at least one of the lead-in opening and the lead-out opening of the through-hole and configured to elastically block the at least one of the lead-in opening and the lead-out opening, the second seal member comprising:

a bonded portion bonded to a part of a periphery of the at least one of the lead-in opening and the lead-out opening; and a non-bonded portion not bonded to the periphery of the at least one of the lead-in opening and the lead-out opening and configured to allow the first seal member to move on the non-bonded portion, the non-bonded portion configured to elastically block the at least one of the lead-in opening and the lead-out opening when the first seal member is pulled out from the through-hole through the non-bonded portion, the image forming apparatus further comprising:

an engaging member provided on an outer surface of the image forming apparatus and configured to engage the pull end of the first seal member of the developer container.

* * * * *